US005526852A

United States Patent [19]

Rakovski

[11] Patent Number: 5,526,852

[45] Date of Patent: Jun. 18, 1996

[54] PUNCHING AND STAMPING TOOL

[76] Inventor: Zvonko Rakovski, 15 Veronica Cres., Sharon, Ontario, Canada, L0G 1O0

[21] Appl. No.: 259,692

[22] Filed: Jun. 13, 1994

[51] Int. Cl.[6] ..... B21F 09/02

[52] U.S. Cl. ..... 140/93.2; 140/152

[58] Field of Search ..... 140/93 R, 93.2, 140/93.4, 150, 152, 153

[56] References Cited

U.S. PATENT DOCUMENTS

| | | | |
|---|---|---|---|
| 235,398 | 12/1880 | Anthes | 140/152 |
| 2,210,510 | 8/1940 | Sutton | 140/93.2 |
| 3,241,579 | 3/1966 | Partridge | 140/93.2 |
| 4,398,572 | 8/1983 | Fromm . | |
| 5,029,433 | 7/1991 | Werk . | |

FOREIGN PATENT DOCUMENTS 0091578 10/1983 European Pat. Off. .

OTHER PUBLICATIONS

Fromm Model KMK Strapping Tool Owner's Manual, Published in the U.S.

Titan HKE Strapping Tool Owner's Manual, Published in the US and Germany.

Orgapack Model 43 Owner's Manual, Published in the US and Germany.

Orgapack Model 48 Owner's Manual, Published in the US and Germany.

*Primary Examiner*—Lowell A. Larson

*Attorney, Agent, or Firm*—Riches, McKenzie & Herbert

[57] ABSTRACT

A punching and stamping tool and a fastening device for using this tool is disclosed. The punching and stamping tool comprises a driving mechanism which moves an upper tool section, having a die, towards a lower tool section, having a punch, to punch at least a pair of angled hooking cuts into two metal bands, such as the overlapping ends of a strap wrapped around a package. The angled hooking cuts effectively fasten the bands together. The driving mechanism comprises a cam, which moves the upper tool section to a set position where the upper tool section is a distance from the lower tool section approximately equal to the thickness of the bands. The driving mechanism also comprises an eccentric shaft having a throw which acts on the upper tool section to punch the angled hooking cuts into the bands.

17 Claims, 10 Drawing Sheets

PUNCHING AND STAMPING TOOL

BACKGROUND OF THE INVENTION

This invention relates to a punching and stamping tool for joining together overlapping steel bands. In particular, the present invention relates to a punching and stamping tool used in a fastening device to fasten together the overlapping ends of a strap wrapped around a package.

Hooper and strapper devices for binding together the overlapping ends of a metal strap wrapped around a package generally comprise an upper tool having a die which moves onto a corresponding stationary lower tool having a punch. The upper and lower tools act on overlapping ends of the strap to execute a punching and stamping operation to produce at least a pair of angled hooking cuts in both of the overlapping ends as disclosed, for example, in U.S. Pat. No. 5,029,433 to Werk.

The angled hooking cuts are such that the lower band is "woven" or "hooked" onto the upper band to fasten together the overlapping ends in a known manner. The angled hooking cuts can be of any shape to permit the lower band to be "woven" or "hooked" onto the upper band, but generally the cuts comprise an angled cut located between a wide cut region and a narrow cut region on the band. Usually, the bands are relatively biased during the punching action such that once the overlapping ends of the strap are trimmed off, the bands slide somewhat toward each other thereby hooking together the projecting corners of the bands created by the angled hooking cuts in the bands.

Generally the strapping is made from a metal, and in particular steel. It is appreciated that punching and stamping steel in order to effect the desired angled hooking cuts requires a great deal of force. Prior art devices such as those disclosed in U.S. Pat. No. 5,029,433 to Werk and U.S. Pat. No. 4,398,572 to Fromm disclose punching and stamping tools which cause the upper moving die to move in a pivoting or rocking motion. These prior art devices perform this type of pivoting or rocking motion in order to cut a portion of the angled hooking cuts first, cutting the remainder of the angled hooking cuts at a later time thereby reducing the maximum force required to perform the punching procedure.

These prior art devices suffer from several disadvantages. In particular, the rocking or pivoting motion of the die required the housing to be considerably larger than the mounting block upon which the die was mounted. This resulted in an increased amount of dust and dirt entering the housing and increasing the wear of the components. In addition, these prior art devices generally utilized the interaction of a cam on a roller device to create the pivoting or rocking motion. This arrangement resulted in a substantial amount of the forces being transferred through a hairline juncture between the cam and roller device. It is apparent that by having concentrations of such forces on a hairline juncture, increased wear and tear results.

SUMMARY OF THE INVENTION

Accordingly, it is an object of this invention to at least partially overcome the disadvantages of the prior art. Also, it is an object of this invention to provide an alternative type of punching and stamping tool wherein the upper moving tool having the die is driven by a driving mechanism which moves the upper tool along a path substantially perpendicular to the surface of the metal bands being joined together, but keeping the required force to effect the punching process relatively weak. It is also an object of the present invention to provide a driving mechanism having a double action or two step driving motion wherein a first setting means provides a relatively quick movement of the upper tool section to a set position near the lower tool during the initial activation of the driving means and then a second slower but more powerful punching drive means engages to execute the punching procedure.

It is also an object of this invention to provide a punching and stamping tool wherein the upper tool is mounted on a mounting block which moves completely within an aperture of a housing such that the aperture is substantially the same size and shape as the mounting block. This aperture can define a passageway. This prevents the entrance into the punching and stamping tool of dust and dirt which increases the wear of the moving, force bearing parts.

Accordingly, in one of its aspects, this invention resides in providing a punching and stamping tool for fastening two metal bands together, said bands extending lengthwise in a longitudinal direction and each band having a thin side and a wide side, said wide side having a thickness in a direction perpendicular to the longitudinal direction and defining a surface extending substantially parallel to the longitudinal direction, said tool comprising: an upper tool section and a lower tool section for fastening the metal bands together and adapted to receive said bands therebetween when the upper tool section is in a first position and wherein the bands are received lengthwise between the upper tool section and lower tool section such that the surfaces of the bands face the upper and lower tool sections; and a driving mechanism for moving the upper tool section towards the lower tool section along a path substantially perpendicular to the surfaces of the bands.

Further aspects of the invention reside in providing a punching and stamping tool for fastening two metal bands together, said bands extending lengthwise in a longitudinal direction and each band having a thin side and a wide side, said wide side having a thickness in a direction perpendicular to the longitudinal direction and defining a surface extending substantially parallel to the longitudinal direction, said tool comprising: an upper tool section and a lower tool section for fastening the metal bands together and adapted to receive said metal bands lengthwise therebetween when said upper tool section is in a first position; a driving mechanism for moving the upper tool section towards the lower section along a path, said driving mechanism comprising: setting means for moving the upper tool section towards the lower tool section from the first position to a set position wherein the upper tool section is a distance above the lower tool section substantially equal to a sum of the thicknesses of the bands; punching drive means for moving the upper tool section towards the lower tool section to produce at least one pair of angled hooking cuts in and along both metal bands; and wherein said setting means moves said upper tool section to the set position before the punching drive means moves the upper tool section resulting in the angled hooking cuts.

In a still further aspect, the present invention resides in providing a strapping device comprising: a tensioning means for tensioning a portion of a metal strap wrapped around a package, said strap having overlapping ends extending lengthwise in a longitudinal direction and each end having a thin side and a wide side, said wide side having a thickness in a direction perpendicular to the longitudinal direction and defining a surface extending substantially parallel to the longitudinal direction; punching and stamping tool means for fastening said overlapping ends; said punching and stamping tool means comprising: an upper tool section and a lower tool section adapted to receive said overlapping ends therebetween when in a first position and for fastening said overlapping ends together; a driving mechanism for moving the upper tool section towards the lower section along a path, said driving mechanism comprising: setting means for moving the upper tool section towards the lower tool section from the first position to a set position wherein the upper tool section is a distance above the lower tool section substantially equal to a sum of the thicknesses of the overlapping ends; punching drive means for moving the upper tool section towards the lower tool section to produce at least one pair of angled hooking cuts in and along said overlapping ends; and wherein said setting means moves said upper tool section to the set position before the punching drive means produces the angled hooking cuts.

Further aspects of the invention will become apparent upon reading the following detailed description and the drawings which illustrate the invention and preferred embodiments of the invention.

BRIEF DESCRIPTION OF THE DRAWINGS

In the drawings, which illustrate embodiments of the invention.

DETAILED DESCRIPTION OF PREFERRED EMBODIMENTS OF THE INVENTION

Figure 1A:
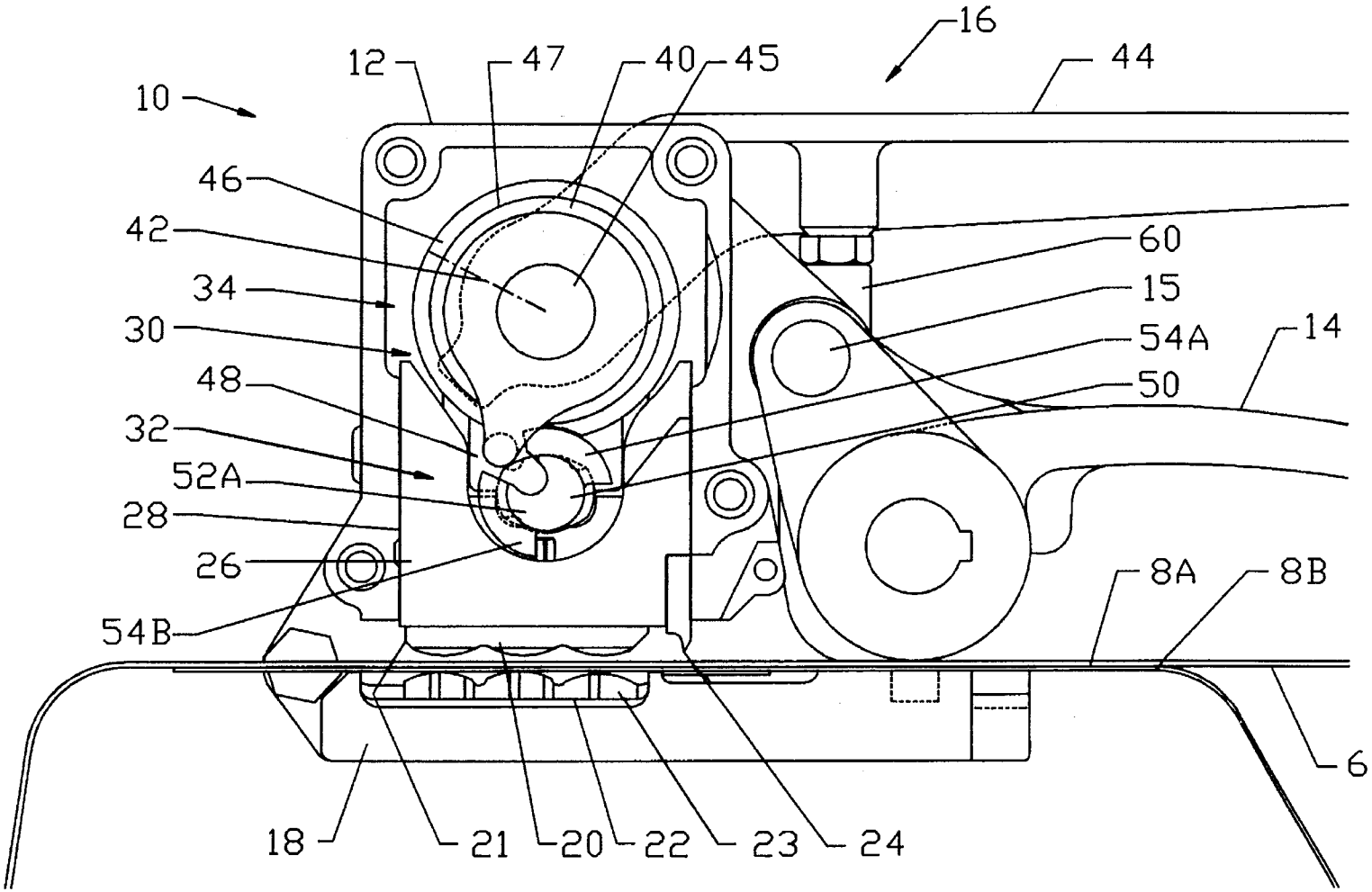
FIG. 1A shows the front view of one embodiment of the present invention with the front cover removed and the upper tool section in the first position.

As shown in FIG. 1A, one embodiment of the present invention comprises a punching and stamping tool, shown generally as 10, having a housing 12. The housing 12 has an annular extension 15 to which may be connected tensioning devices, shown generally as 14 in FIG. 1A.

The tensioning device 14 may be used to relatively bias the metal bands 8A and 8B. For example, in the case where metal bands 8A and 8B form the overlapping ends of a strap, shown generally as 6 in FIG. 1A, the tensioning device 14 is used to place the strap 6 under tension around a package (not shown). In this way, metal bands 8A and 8B, representing the overlapping ends of strap 6, would be relatively biased because the strap 6 would be under tension.

Tensioning devices such as tension device 14 are known in the art and can be readily connected to the punching tool 10 by means of the annular extension 15. The combination of the tensioning device 14 and the punching tool 10 forms a strapping device, shown generally as 16 in FIG. 1A, to place a strap 6 wrapped around a package (not shown) under tension and fasten the overlapping ends of the strap 6, namely the bands 8A and 8B, together.

Tool 10 has an upper tool section 20 which comprises a tool such as a die 21. Tool 10 further has a lower tool section 22 which comprises a tool such as a punch 23. Upper tool section 20 and lower tool section 22 are arranged such that the respective tools, in this embodiment the die 21 and punch 23, can operate on the bands 8A and 8B to perform a punching and stamping operation.

Upper tool section 20 further comprises a cutter 24 such as a knife. The cutter 24 performs the function of cutting any excess metal from the band 8A after the punching procedure has occurred.

Base plate 18 is connected to the housing 12 by a generally C-shaped member (not shown). In this way, housing 12 and base plate 18 form an integral body.

In a preferred embodiment, upper tool section 20 is mounted onto a mounting block 26. In a similar manner, lower tool section 22 is mounted onto the base plate 18.

Figure 7:
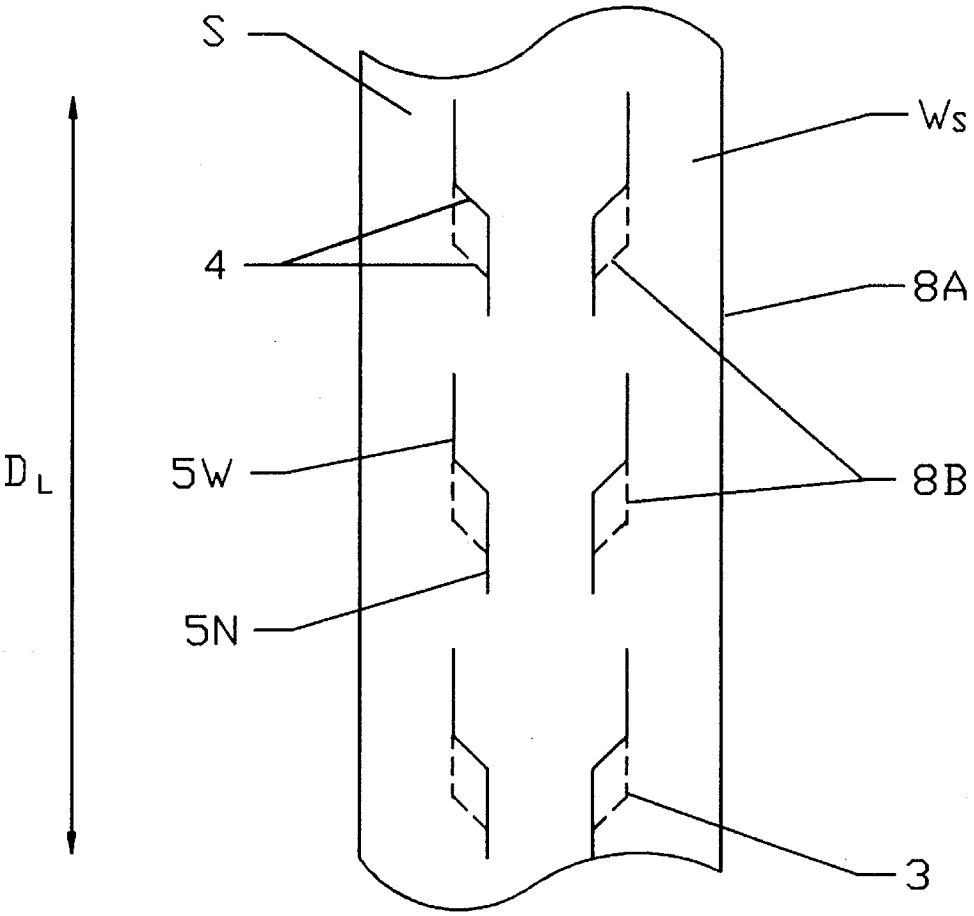
FIG. 7 is a top view of the angled hooking cuts produced in the metal bands by one embodiment of the invention.

The upper and lower tool sections 20, 22 perform the punching operation to form angled hooking cuts 4, shown generally in FIG. 7. The angled hooking cuts 4 can be of any shape to permit the lower band 8B (shown in dotted lines in FIG. 7) to be "woven" or "hooked" into the upper band 8A. Generally, the angled hooking cuts 4 are approximately 30 to 45 degrees with respect to the longitudinal direction $D_L$ in which the bands 8A, 8B extend. In any case, a pair of the angled hooking cuts 4 are generally located between a wide cut region 5W and a narrow cut region 5N on the bands 8A and 8B. There should be at least one pair of angled hooking cuts 4, and preferably two or three pairs of angled hooking cuts 4, along both bands 8A, 8B to ensure the bands are well fastened together.

Usually, the bands 8A, 8B are relatively biased during the punching procedure such that once the overlapping ends of the strap 6 are cut off by cutter 24, the bands 8A, 8B slide somewhat away from each other. In this way, the projecting corners 3 of the bands 8A and 8B created by the angled hooking cuts 4 as shown in FIG. 7 hook together because a portion of the bottom band 8B (shown in FIG. 7 in dotted lines) "overlaps with" or "is hooked into" the angled hooking cuts 4 of the top band 8A. It is appreciated that the bands 8A, 8B can be relatively biased by means of the tensioning device 14, or any other means whereby the bands 8A and 8B have a relative bias. In the case where the bands 8A and 8B are the overlapping ends of a strap 6, the strap is under tension around an object such as a package (not shown) thereby causing the bands 8A, 8B to be relatively biased. If the bands are not relatively biased, other means may be used to effectively "hook" the bands 8A, 8B.

The bands 8A, 8B are known in the art and are made of a metal, and usually steel. The bands 8A, 8B extend lengthwise in a longitudinal direction $D_L$, as shown in FIG. 7. Each band 8A, 8B has a thin side $T_S$ and a wide side $W_S$ (see FIGS. 2A and 7). The wide side $W_S$ of each band 8A, 8B has a thickness $T_A$, $T_B$, respectively, in a direction $D_P$ substantially perpendicular to the longitudinal direction $D_L$. The wide side $W_S$ of each band 8A, 8B also defines a surface S extending substantially parallel to the longitudinal direction $D_L$.

In the present embodiment, the lower tool section 22 remains stationary relative to the bands 8A and 8B while the upper tool section 20 moves towards the lower tool section 22 and the bands 8A, 8B to produce the angled hooking cuts 4. Movement of the upper tool section 20 towards the lower tool section 22 is accomplished by the driving mechanism, shown generally as 30 in FIG. 1A, moving mounting block 26, upon which the upper tool section 20 is mounted, towards the base plate 18 and the lower tool section 22. Preferably, the driving mechanism 30 moves the upper tool section 20 towards the lower tool section along a path which is substantially perpendicular to the surfaces S of the bands 8A, 8B, and substantially straight as seen in FIGS. 1A, 2A, 3 and 4A.

The driving mechanism 30 comprises a two step or "double action" driving means. For example, in one embodiment, the driving mechanism comprises a setting means, shown generally in FIG. 1A as 32, for moving the upper tool section 20 to a "set position" shown in FIGS. 2A and 2B, from a "first position" shown in FIGS. 1A and 1B. The driving mechanism 30 further comprises a punching drive means, shown generally as 34 in FIG. 1A. The punching drive means 34 provides a stronger force for moving the upper tool section 20 towards the lower tool section 22 to produce the angled hooking cuts 4 in and along the metal bands 8A, 8B during the punching procedure. The setting means 32 moves the upper tool section 20 to the set position before the punching drive means 34 moves the upper tool section 20 resulting in the angled hooking cuts 4.

Figure 1B:
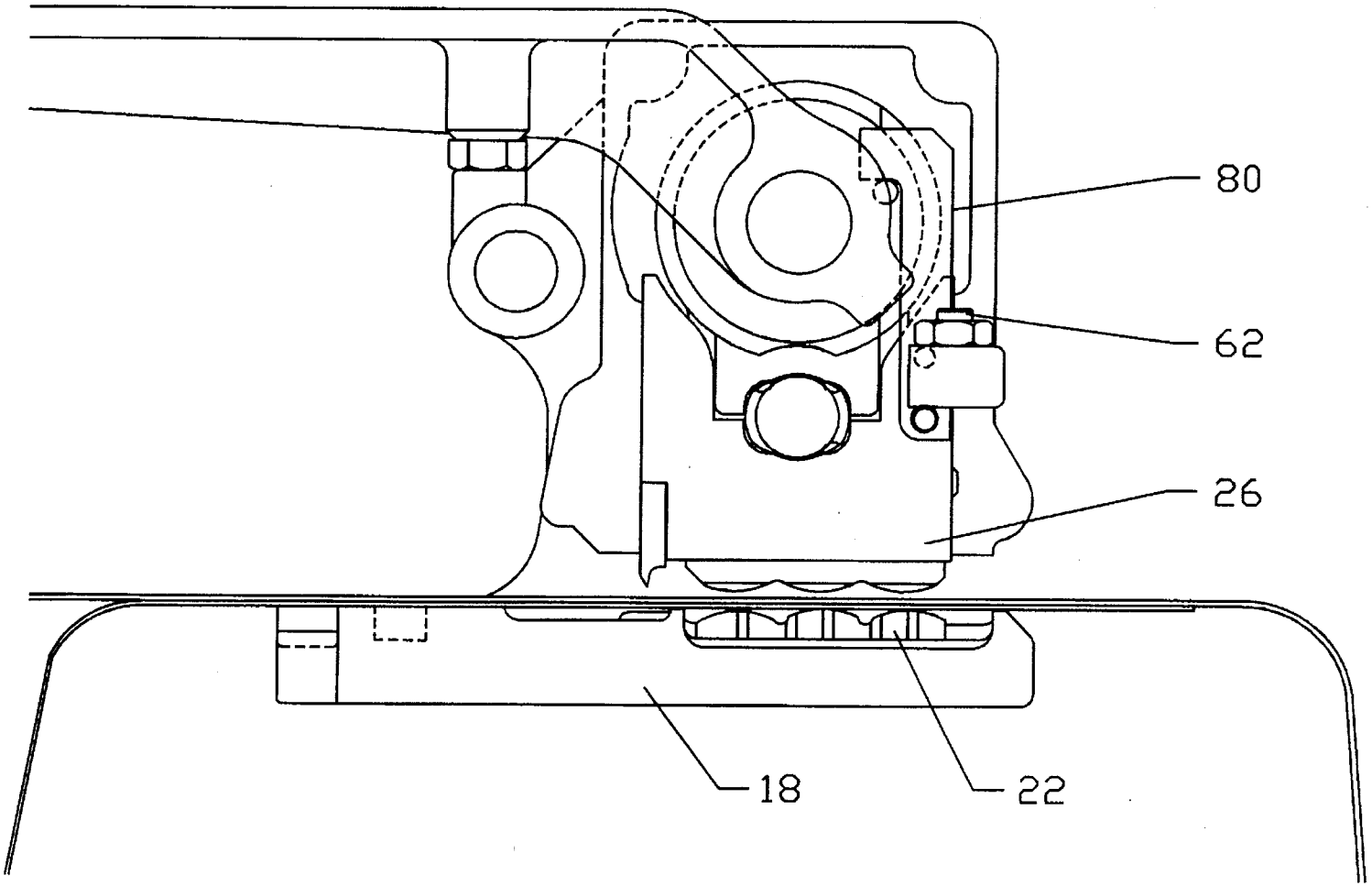
FIG. 1B shows a reverse view of FIG. 1A with the rear panel removed.

In the "first position", as shown in FIGS. 1A and 1B, the upper tool section 20 and lower tool section 22 are in the open or furthest apart position from each other so that they can receive the metal bands 8A, 8B therebetween. The upper tool section 20 and lower tool section 22 are adapted to receive the metal bands therebetween lengthwise in the longitudinal direction $D_L$ such that the surface S of each band 8A, 8B faces the upper and lower tool sections 20, 22 as shown in FIGS. 1A and 1B. It is apparent that the surfaces S of the bands 8A, 8B are substantially coincident between the upper and lower tool section 20, 22.

Figure 2A:
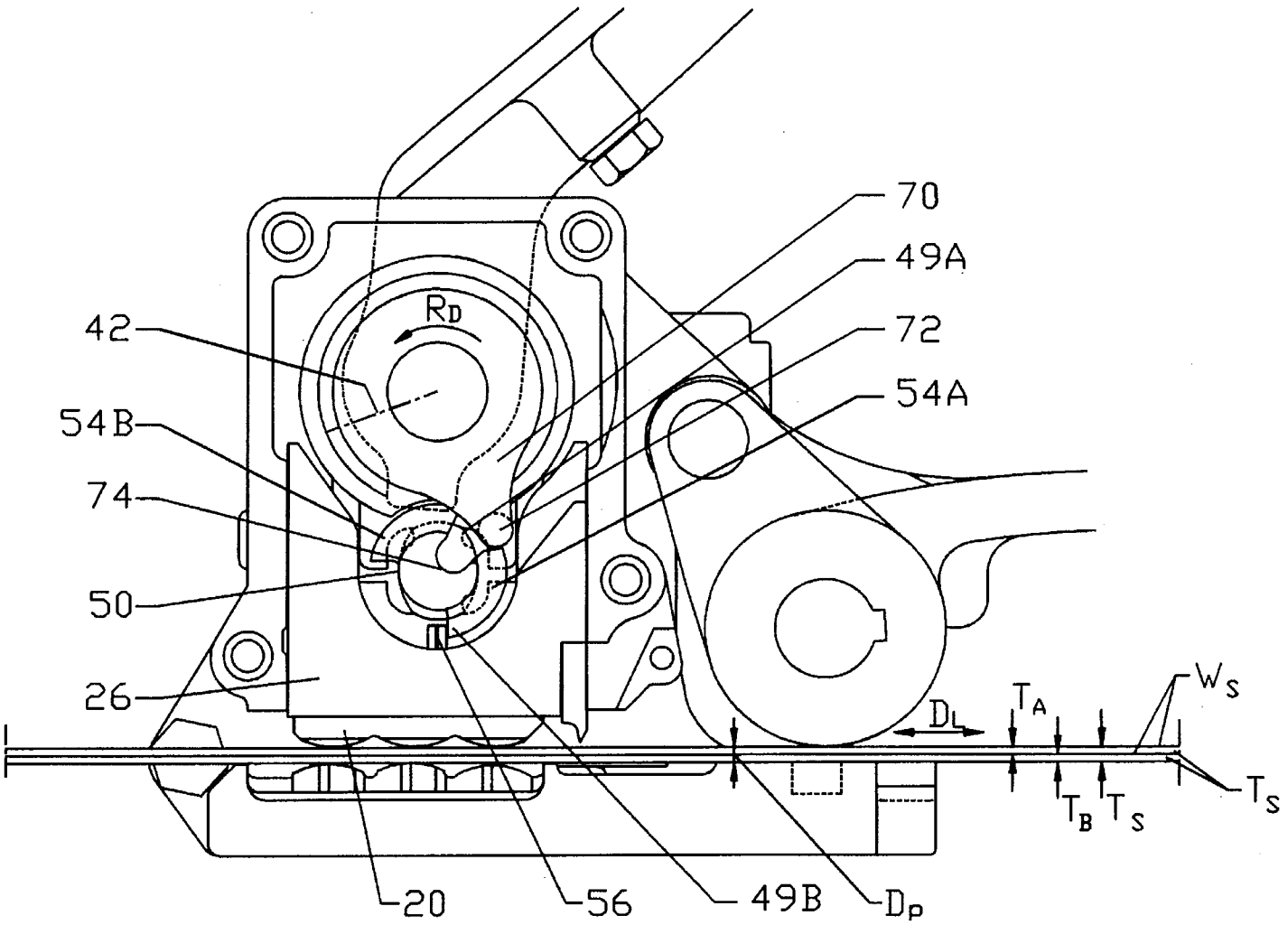
FIG. 2A shows one embodiment of the present invention from a front view with the front panel removed and the upper tool sections in the set position.
Figure 2B:
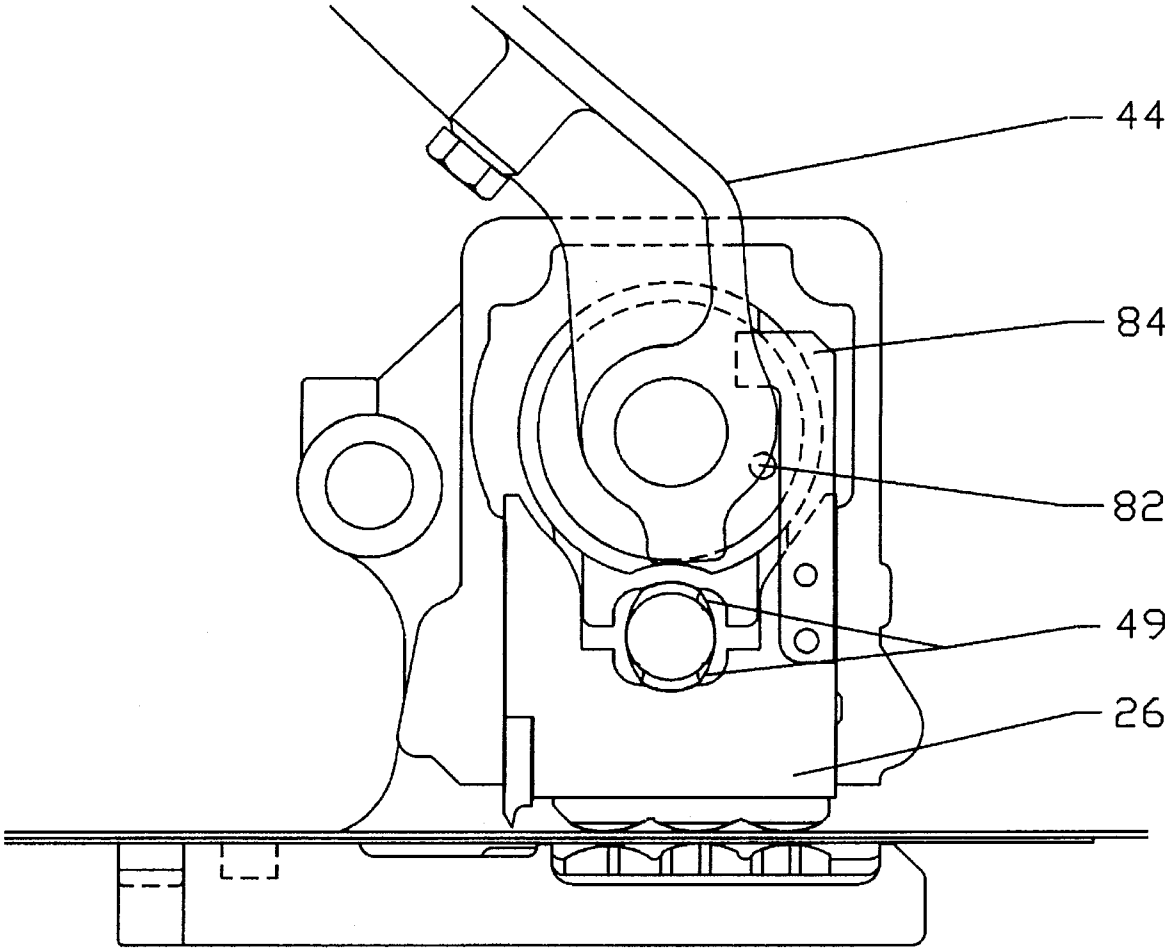
FIG. 2B shows a reverse view of FIG. 2A with the rear panel removed.
Figure 3:
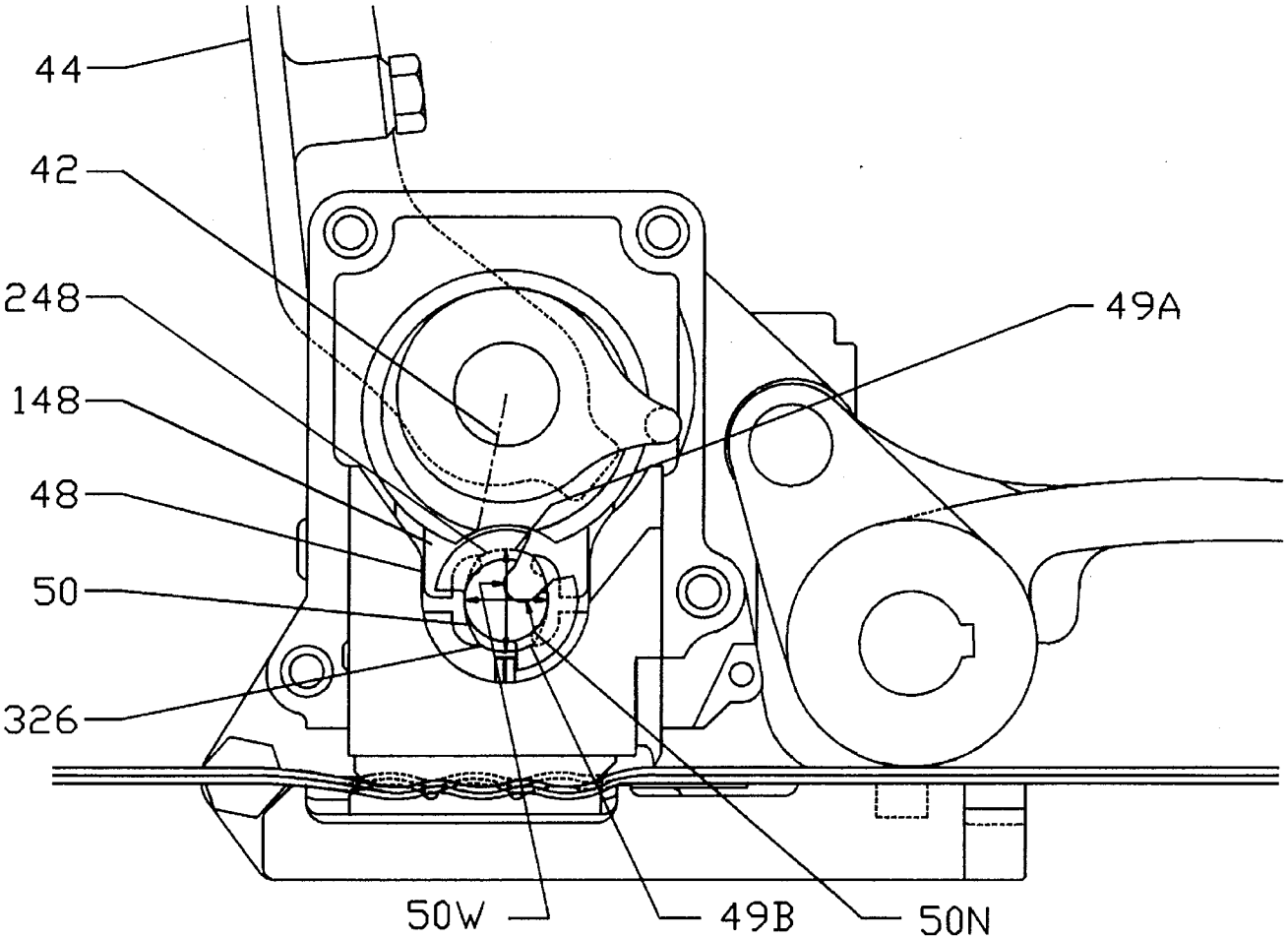
FIG. 3 shows one embodiment of the present invention from a front view with the front panel removed and the upper tool section in an intermediate position.
Figure 4A:
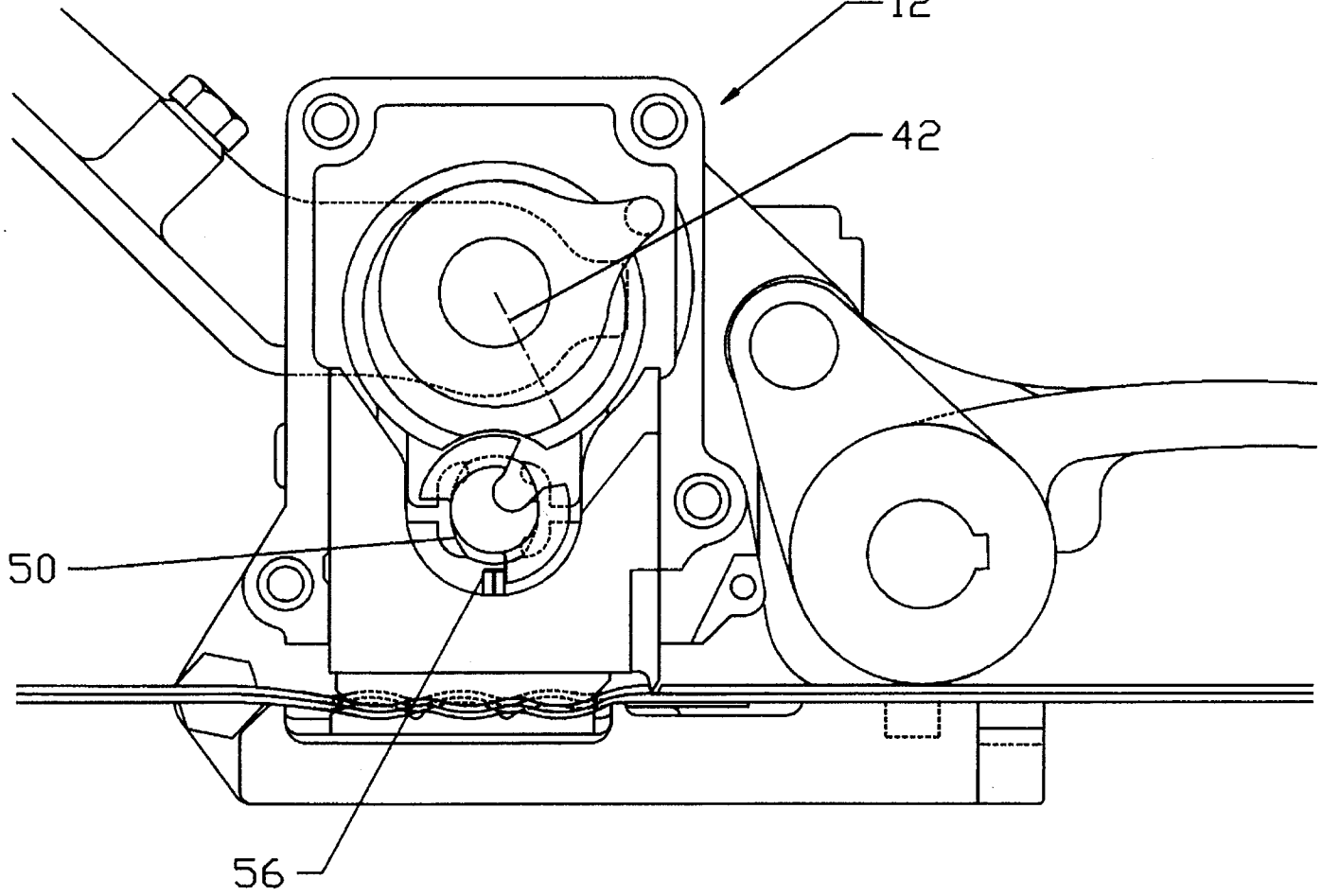
FIG. 4A shows one embodiment of the present invention from a front view with the front panel removed and the upper tool section in a final position.
Figure 4B:
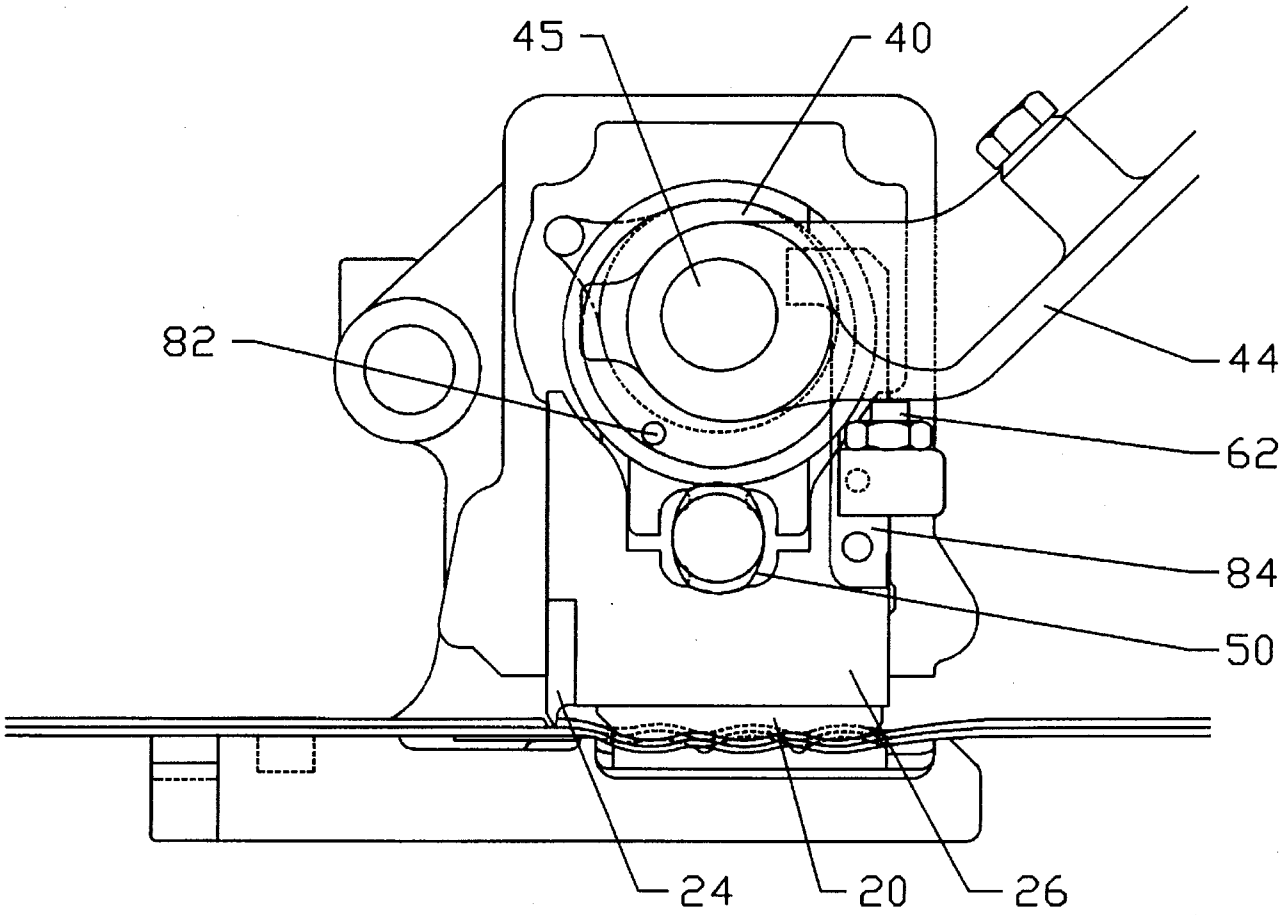
FIG. 4B shows a reverse view of FIG. 4A with the rear panel removed.

In the set position, shown in FIGS. 2A and 2B, the upper tool section 20 is a distance above the lower tool section 22 substantially equal to the sum of the thickness of the two bands 8A, 8B (shown as $T_S$ in FIG. 2A). In other words, in the set position, the upper tool section 20 is set to begin the punching procedure. FIG. 3 shows the upper tool section 20 in an intermediate position during the punching procedure. FIGS. 4A and 4B show the upper tool 20 in a final position at the conclusion of the punching procedure and after the cutter 24 has cut the excess metal from band 8A.

Once the setting means 32 has moved the upper tool section 20 to the set position, shown in FIG. 2A, the punching drive means 34 operates to move the upper tool section 20 towards the lower tool section 22 to produce sufficient force so that the tool sections 20, 22 cut at least one pair of angled hooking cuts 4 in and along the bands 8A and 8B as shown in FIG. 7.

It is apparent from FIGS. 2 to 4 that as the punching drive means 34 moves the upper tool section 20 towards the lower tool section 22 to produce the angled hooking cuts 4, the punching drive means 34 substantially simultaneously moves the setting means 32 towards the lower tool section 22 also. It is also apparent that while the setting means 32 moves the upper tool section 20 to the set position, the punching drive means 34 may also move the upper tool section 20 and the setting means 32 towards the lower tool section 20, but the movement caused by the setting means 32 is generally substantially greater than that caused by the punching drive means 34.

In one embodiment, as shown in FIG. 1A, the punching drive means 34 comprises an eccentric shaft 40 having a throw, shown generally as 42. The eccentric shaft 40 can be operated manually by means of handle 44 to rotate the eccentric shaft 40 in a rotational direction $R_D$ so that the throw operates on the upper tool section 20. It is apparent that the eccentric shaft 40 could also be operated upon by an automatic rotating means (not shown) utilizing, for example, an electric motor, a pneumatic device or an electromagnetic device to turn the eccentric shaft 40.

The shaft 40 is an eccentric shaft because the center of rotation of the shaft 40 is offset from the geometric center of the shaft 40. The term "throw" 42 as used in the present context, is intended to refer to the maximum displacement of the center of rotation of the eccentric shaft 40 from the cylindrical surface 47 of the shaft 40, shown by the dot-dash line in FIG. 1A. In this embodiment, the center of rotation of the eccentric shaft 40 corresponds to the center of pin 45 which connects handle 44 to the eccentric shaft 40. In one preferred embodiment, the center of rotation is offset from the geometric center by 50 to 70 thousandths of an inch making the throw 42 the radius of the eccentric shaft 40 plus 50 to 70 thousandths of an inch.

To increase the ease of rotation, it is preferable that bearings, such as needle bearings 46, be oriented around the cylindrical surface 47 of the eccentric shaft 40. The eccentric shaft 40 then acts through the needle bearings 46 upon a force bearing block 48. As shown in FIG. 1A, it is preferable that the force bearing block 48 have a first curved contact surface 148 (shown in FIG. 3) facing the eccentric shaft 40. This first curved contact surface has a curvature corresponding to the cylindrical surface 47 of the eccentric shaft 40. In this way there is a large contact surface area between eccentric shaft 40 and the force bearing block 48. Preferably, the needle bearings 46, or other means to assist rotation, are located at least along this contact surface, and more preferably around the entire cylindrical surface 47 as shown in FIGS. 1 to 4.

The force bearing block 48 in turn operates on a cam 50 which forms part of the setting means 32 as described more fully below. The force bearing block 48 is located between the eccentric shaft 40 and cam 50. The cam 50 then operates on the mounting block 26 to which is mounted the upper tool section 20. In this way, a force sufficient to perform the punching operation is transferred from the eccentric shaft 40 to the upper tool section 20.

As stated above, the setting means 32 comprises a cam 50. The cam 50, in a preferred embodiment, is elliptically shaped having a narrow portion 50N and a wider portion 50W (see FIGS. 3 and 5A, 5B). When the upper tool section 20 is in the open or first position, the cam 50 is oriented such that the wider portion 50W is parallel to the bands 8A, 8B (shown in a horizontal position in FIG. 1A and 1B) such that the mounting block 26 is in the uppermost position. During the initial rotation of the handle 44, a rotation means, shown generally as 70 in FIG. 2A, rotates the cam 50 approximately 90 degrees such that the wider portion 50W of the cam 50 is perpendicular to the surfaces S of the bands 8A, 8B (shown in a vertical position in FIG. 3). This occurs during the initial rotation of the eccentric shaft 40 and prior to the throw 42 acting on the force bearing block 48 and therethrough on the upper tool section 20. In this way, the cam 50 moves the upper tool section 20 from the first position to the set position.

As shown in FIG. 2A, in one preferred embodiment, the rotation means 70 comprises an extended arm 72 which is connected to the eccentric shaft 40. During the initial rotation of the handle 44, as shown in FIG. 2A, the extended arm 72 is received in a notch 74 associated with the cam 50. The notch 74 is formed by the two ears 54A and 54B shown in both FIGS. 2A, 5A and 5B. In this way, an initial rotation of the eccentric shaft 40, such as 20 to 30 degrees, causes a rotation of the cam 50 of approximately 90 degrees such that the cam 50 moves from a position of minimum displacement of the mounting block 26 (where the wider portion 50W of the cam 50 is parallel to the surfaces S of the bands 8A, 8B and horizontal as shown in FIGS. 1A and 1B) to a position of a maximum displacement of the mounting block 26 (where the wider portion 50W of the cam 50 is perpendicular to the surfaces S of the bands 8A, 8B and vertical as shown in FIGS. 2A, 2B, 3, 4A and 4B).

In a further preferred embodiment, a stop pin 56 is located in the mounting block 26 such that ears 54A and 54B stop the rotation of the cam 50 at the positions of minimum and maximum displacement of the mounting block 26, respectively, as shown at least in FIGS. 1A and 2A.

In a preferred embodiment, the inner surface of the mounting block 26 within which the cam 50 is oriented and the inner surface of the force bearing block 48 also facing the cam 50, have raised areas 49A, 49B in the mid section thereof. These raised areas 49A, 49B are curved with a radius of curvature corresponding to the ends of the wider portion 50W of the cam 50 such that these raised curved areas 49A, 49B "cradle" the ends of the wider portion 50W of the cam 50 when the upper tool section 20 is in the set position. In other words, these raised curved areas 49A, 49B provide a large contact surface area between the cam 50 and the force bearing block 48 and mounting block 26 during the punching operation to decrease the wear and tear on the cam 50 and to further ensure that the cam 50 is in the proper position when the upper tool section 20 is in the set position.

Figure 5B:
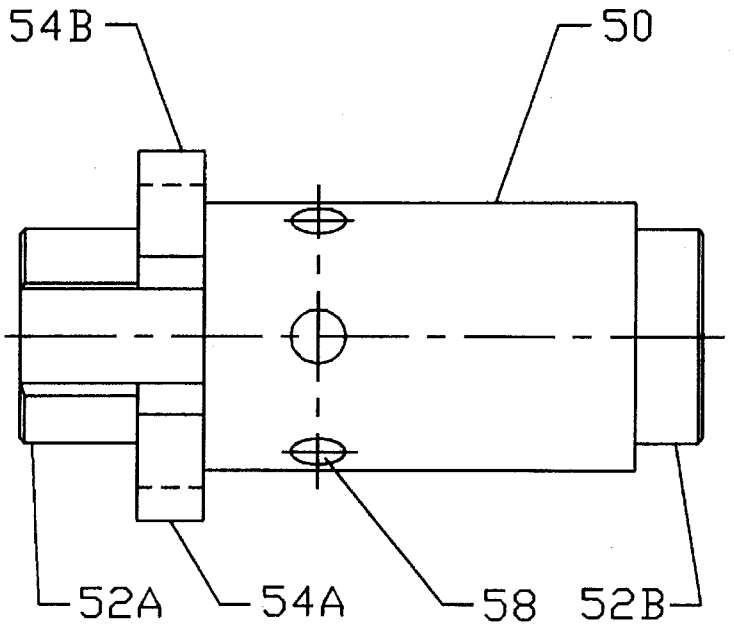
FIG. 5B is a plan view of a cam according to one embodiment of the present invention.
Figure 5A:
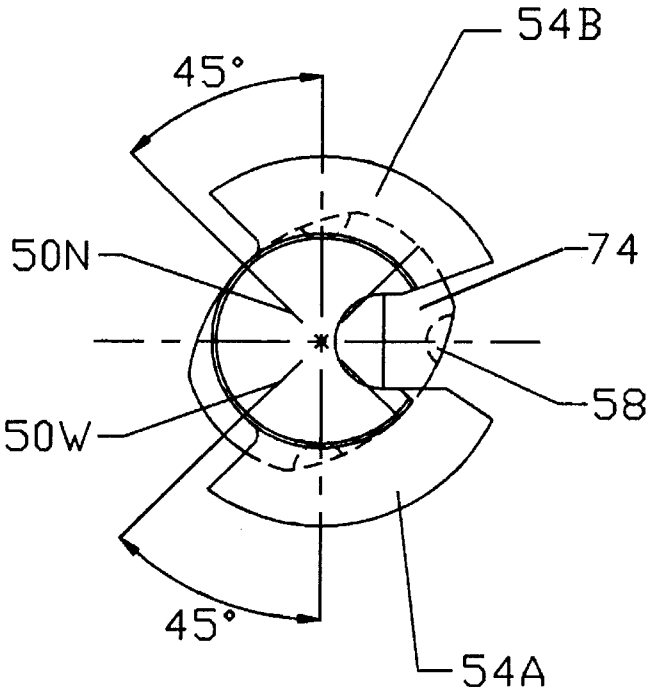
FIG. 5A is a front view of a cam according to one embodiment of the present invention.

The raised portion 49A on the mounting block 48 provides a second curved contact surface 248 facing the wider portion 50W of the cam 50 and having a curvature corresponding to the curvature of an end of the wider portion 50W of the cam 50 (shown in FIGS. 3, 5A and 5B). The second curved contact surface 248 is similar to the first curved contact surface 148. Likewise, the second raised portion 49B provides a third curved contact surface 326 on the mounting block 26 facing the cam 50. The third curved contact surface 326 has a curvature corresponding to the curvature of another end of the wider portion 50W of the cam 50.

In a preferred embodiment, as described above, the punching drive means 34 comprises the eccentric shaft 40 having a throw 42. As shown in FIGS. 3 and 4A, the remaining rotation of the eccentric shaft 40 after the initial rotation, for example through an angle of rotation of 150 to 180 degrees, causes the throw 42 to act upon the upper tool section 20 during the punching procedure. As shown in FIGS. 4A and 4B, at the conclusion of the punching procedure, the angled hooking cuts 4 have been produced and the cutter 24 has cut off any excess of the band 8A.

A preferred embodiment of cam 50 is shown in detail in FIGS. 5A and 5B. In this embodiment, cam 50 comprises circular extensions 52A, 52B. Circular extension 52A is received into the vertical guide 83 of the front cover 81 shown in FIG. 6. Circular extension 52B is received into a corresponding vertical guide in the rear cover (not shown). Circular extensions 52A, 52B have a diameter approximately equal to the thickness of the narrow portion 50N of the cam 50, and, in this embodiment, notch 74 extends into circular extension 52A.

The vertical guide 83 provides additional stability to the cam 50. The guide 83 is vertical to permit the vertical movement of the circular extension 52A during the rotation of the cam 50 to the position of maximum displacement of the mount 26 and then during the actual punching procedure.

Cam 50 also comprises dimples 58 as shown in FIGS. 5A and 5B. The dimples 58 operate in conjunction with a spring and ball apparatus (not shown) which also assists in the positioning of the cam 50 in the positions of minimum and maximum displacement of the mounting block 26 referred to above. For example, a ball pressured downward by a spring operates on dimple 58 when the cam 50 is in its minimum position and a second ball operated upon by a second spring operates on dimple 58, or another dimple, when the cam 50 is in its position of maximum displacement. In this way, the dimples 58 provide additional stability to the cam 50.

The mounting block 26 moves within an aperture 28 of the housing 12. Furthermore, the driving mechanism 30 operates on the mounting block 26 such that the upper tool section 20 moves towards the lower tool section 22 along a path substantially perpendicular to the surfaces S of the bands 8A, 8B. It is noted that in a preferred embodiment, as shown in FIG. 1A, the mounting block is substantially the same size and shape as the aperture 28. Also as shown in FIG. 1A, the aperture 28 need not be a simple opening but a three dimensional passageway. In this way the mounting block 26 can move within the aperture 28 in a sealed manner such that dirt and dust located on the exterior of the housing 12 cannot easily enter into the housing 12 to increase the wear and tear of the driving mechanism 30.

Figure 6:
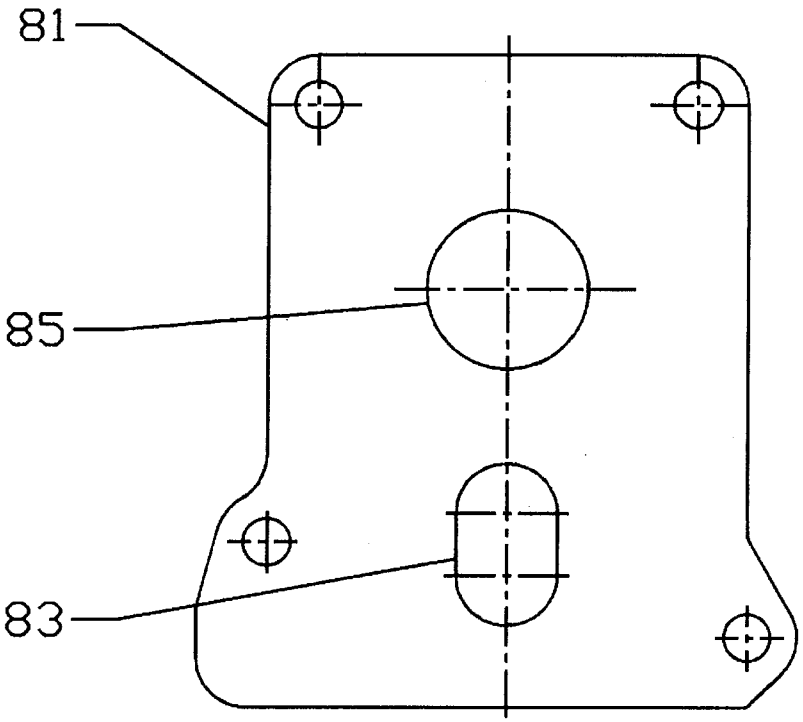
FIG. 6 is a plan view of a cover of the housing in one embodiment of the present invention.

FIG. 6 further shows a recess 85 for receiving the pin 45 shown in FIG. 1A. The pin 45 connects the handle 44 to the eccentric shaft 40. In addition, the pin 45 extends past the handle 44 and is received into recess 85 to provide the support for the eccentric shaft 40 during the punching procedure. It is apparent that the pin 45 is at the center of rotation of the eccentric shaft 40 and therefore does not move horizontally or vertically within the recess 85. The recess 85 is substantially the same size as pin 45 except that, in a preferred embodiment, recess 84 comprises needle bearings (not shown) on the inside thereof to provide smooth rotation of the pin 45. A similar recess and needle bearing arrangement exists on the rear cover (not shown). The pin 45 and recess 84 arrangement provides support for the downward force of the eccentric shaft 40 during the punching procedure.

The rotation of the handle 44 is stopped in the first position by stop 60 and in the final position, after the punching process as shown in FIGS. 4A and 4B, by stop 62. Stops 60 and 62 may or may not be adjustable. In the preferred embodiment as shown in FIGS. 1B and 4B, the final position stop 62 is adjustable and the first position stop 60 is not adjustable but rather is formed from the housing 12.

During reverse movement of the eccentric shaft 40 in a reverse direction to the rotational direction $R_D$, namely during the return of the handle 44 from the punched position, shown in FIGS. 4A and 4B, to the first position, shown in FIGS. 1A and 1B, the mounting block 26 and upper tool section 20 are lifted to the first position and the tool 10 is "reset" for punching. A reset means, shown generally as 80 in FIG. 1B, is used to lift the mounting block 26 and thereby move the upper tool section 20 to the first position from the punched position. The reset means 80 comprises a pin 82, associated with the eccentric shaft 40, and an L-shaped lifting member 84 associated with the pin 82 and connected to the mounting block 26. It is apparent from FIGS. 1B, 2B and 4B that operation of the pin 82 upon the lifting L-shaped member 84 lifts the mounting block 26, and therefore returns the upper tool section 20 to the first position, upon reverse movement of the eccentric shaft 40 and return of the handle 44 to the starting position at stop 60.

During the reverse movement of the eccentric shaft 40, namely as the handle 44 is moved back to the position in FIGS. 1A and 1B, the eccentric shaft 40 returns to the position shown in FIGS. 1A, 1B. Also, the rotation means 70 rotates the cam 50 back approximately 90 degrees to the position of minimum displacement of the mounting block 26 where the wider portion of the cam 50 is horizontal and parallel to the bands 8A, 8B. Stop pin 56 operates on ear 54B to prevent the cam 50 from rotating past the position of minimum displacement. A spring and ball operating on a dimple 58 also ensures that the cam 50 returns to the position of minimum displacement of the block 26. Reverse movement of the eccentric shaft 40 causes the rotation means 70 to rotate the cam 50 to the position of minimum displacement of the mounting block 26 substantially simultaneously as the reset means 80 returns the upper tool section 20 to the first position.

It is understood that the terms "upper" and "lower" used to describe the upper tool section 20 and lower tool section 22 do not restrict the tool 10 to embodiments where the upper tool section 20 is above the lower tool section 22. Rather, the tool 10 can be used in any orientation whether the upper tool section 20 is above, below, or to the side of the lower tool section 22. With respect to the embodiment where the bands 8A, 8B are the overlapping ends of a strap 6 wrapped around a package, the upper tool section 20 will be further away from the package than the lower tool section 22.

It is also understood that when it is said the upper tool section 20 is "mounted" onto the mounting block 26, this is intended to mean that the upper tool section 20 is attached, welded connected, as well as formed, fabricated moulded or otherwise positioned onto the mounting block 26. The term "mounted" has a similar intended meaning when it is said the lower tool section 22 is "mounted" to the base plate 18. The manner in which the upper and lower tool sections 20 and 22 are formed or positioned onto the mounting block 26 and base plate 18 has no effect on the operation of the present invention.

It is understood that the punching drive means 34 need not necessarily utilize an eccentric shaft 40 to perform the punching operation. Any mechanical means to effect a strong downward force may be used, such as a cam or crankshaft. However, it is preferable to use an eccentric shaft 40 as described above.

Likewise, it is understood that the setting means 32 need not necessarily comprise a cam 50 to move the upper tool section 20 to the set position. Any mechanical means for effecting this movement may be used, including an eccentric shaft. However, it is preferable to use a cam 50 as described above.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

The embodiments of the invention in which an exclusive property or privilege is claimed are defined as follows:

1. A punching and stamping tool for fastening two metal bands together, said bands extending lengthwise in a longitudinal direction and each band having a thin side and a wide side, said wide side having a thickness in a direction perpendicular to the longitudinal direction and defining a surface extending substantially parallel to the longitudinal direction, said tool comprising:

an upper tool section and a lower tool section for fastening the metal bands together and adapted to receive said bands therebetween when the upper tool section is in a first position and wherein the bands are received lengthwise between the upper tool section and lower tool section such that the surfaces of the bands face the upper and lower tool sections; and a driving mechanism for moving the upper tool section towards the lower tool section along a path substantially perpendicular to the surfaces of the bands, said driving mechanism comprising:

setting means comprising cam means for moving the upper tool section towards the lower tool section from the first position to a set position wherein the upper tool section is a distance above the lower tool section substantially equal to a sum of the thickness of the bands;

punching drive means for moving the upper tool section towards the lower tool section to produce at least one pair of angled hooking cuts in and along both metal bands, said punching drive means comprising eccentric shaft means having a cylindrical surface and having a throw, wherein rotation of the eccentric shaft means in a rotational direction causes the throw to act upon the upper tool section to produce the angled hooking cuts;

wherein said setting means moves said upper tool section to the set position before the punching drive means moves the upper tool section resulting in the angled hooking cuts; and wherein a force transferring member is located between the eccentric shaft means and the cam means, said force transferring member having a first curved contact surface facing the eccentric shaft means, said first curved contact surface corresponding to the cylindrical surface of the eccentric shaft means, and said force transferring member having a second curved contact surface facing a portion of the cam means, said second curved contact surface corresponding to a curvature of the portion of the cam means.

2. A punching and stamping tool as defined in claim 1 wherein when said punching drive means moves said upper tool section towards the lower tool section, the punching drive means substantially simultaneously moves said setting means towards said lower tool section.

3. A punching and stamping tool as defined in claim 2 further comprising:

a mounting block having said upper tool section mounted thereto; and a housing for housing said driving mechanism and mounting block, wherein said housing has aperture means having a size and a shape, and wherein said mounting block moves in said aperture means and is substantially the same size and shape as said aperture means.

4. A punching and stamping tool as defined in claim 3 wherein said eccentric shaft means further comprises bearing means between the cylindrical surface and the first curved contact surface.

5. A punching and stamping tool as defined in claim 4 wherein an initial rotation of said eccentric shaft means in the rotational direction causes the cam means to move said upper tool section from said first position to said set position.

6. A punching and stamping tool as defined in claim 5 wherein the two bands of metal are overlapping ends of a strap under tension.

7. A punching and stamping tool for fastening two metal bands together, said bands extending lengthwise in a longitudinal direction and each band having a thin side and a wide side, said wide side having a thickness in a direction perpendicular to the longitudinal direction and defining a surface extending substantially parallel to the longitudinal direction, said tool comprising:

an upper tool section and a lower tool section for fastening the metal bands together and adapted to receive said metal bands lengthwise therebetween when said upper tool section is in a first position;

a driving mechanism for moving the upper tool section towards the lower section along a path, said driving mechanism comprising:

setting means comprising cam means for moving the upper tool section towards the lower tool section from the first position to a set position wherein the upper tool section is a distance above the lower tool section substantially equal to a sum of the thicknesses of the bands;

punching drive means for moving the upper tool section towards the lower tool section to produce at least one pair of angled hooking cuts in and along both metal bands, said punching drive means comprising eccentric shaft means having a throw, wherein rotation of the eccentric shaft means in a rotational direction causes the throw to act upon the upper tool section to produce the angled hooking cuts;

wherein said setting means moves said upper tool section to the set position before the punching drive means moves the upper tool section resulting in the angled hooking cuts;

rotation means attached to said eccentric shaft means for rotating the cam means wherein an initial rotation of said eccentric shaft means in said direction causes the rotation means to rotate the cam means thereby moving the upper tool section to the set position;

wherein continued rotation of said eccentric shaft means causes said throw to act upon the upper tool section; and wherein when said punching drive means moves said upper tool section towards the lower tool section, the punching drive means substantially simultaneously moves said setting means towards said lower tool section.

8. A punching and stamping tool as defined in claim 7 wherein the bands are received between said upper tool section and lower tool section such that the surfaces of the bands face the upper and lower tool sections; and wherein the path is substantially perpendicular to the surfaces of the bands.

9. A punching and stamping tool as defined in claim 8 further comprising:

a mounting block having said upper tool section mounted thereto; and a housing for housing said eccentric shaft means, cam means and mounting block, wherein said housing has aperture means having a size and shape and wherein said mounting block moves in said aperture means and is substantially the same size and shape as said aperture means.

10. A punching and stamping tool as defined in claim 9 wherein the cam means has a narrow portion and a wider portion;

wherein when the wider portion is parallel to the surfaces of the bands, the cam means is in a position of minimum displacement of the mounting block and the upper tool section is in the first position;

wherein when the wider portion is perpendicular to the surface of the bands, the cam means is in a position of maximum displacement of the mounting block and the upper tool section is in the set position; and wherein the rotation means comprises an extended arm connected to said eccentric shaft means and receivable by said cam means wherein said initial rotation of the eccentric shaft means causes the extended arm to rotate the cam means from the position of minimum displacement of the mounting block to the position of maximum displacement of the mounting block.

11. A punching and stamping tool as defined in claim 10 further comprising a force transferring member located between the eccentric shaft means and the cam means, said force transferring member having a first curved contact surface facing the eccentric shaft means, said first curved contact surface corresponding to a cylindrical surface of the eccentric shaft means, and said force transferring member having a second curved contact surface facing an end of the wider portion of the cam means, said second curved contact surface corresponding to a curvature of the end of the wider portion of the cam means.

12. A punching and stamping tool as defined in claim 11 wherein said eccentric shaft means further comprises bearing means between the cylindrical surface and the first curved contact surface.

13. A punching and stamping tool as defined in claim 12 further comprising a reset means associated with the eccentric shaft means for returning the upper tool section to the first position during reverse movement of said eccentric shaft means; and wherein reverse movement of the eccentric shaft means causes the rotation means to return the cam means to the position of minimum displacement of the mounting block substantially simultaneously as the reset means returns the upper tool section to the first position.

14. A punching and stamping tool as defined in claim 13 wherein the bands are relatively biased.

15. A punching and stamping tool as defined in claim 14 wherein the two bands of metal are overlapping ends of a strap under tension and said tool further comprises tensioning means for placing said strap under tension, and, cutter means for cutting any excess metal from the strap.

16. A strapping device comprising:

a tensioning means for tensioning a portion of a metal strap wrapped around a package, said strap having overlapping ends extending lengthwise in a longitudinal direction and each end having a thin side and a wide side, said wide side having a thickness in a direction perpendicular to the longitudinal direction and defining a surface extending substantially parallel to the longitudinal direction;

punching and stamping tool means for fastening said overlapping ends; said punching and stamping tool means comprising:

an upper tool section and a lower tool section adapted to receive said overlapping ends therebetween when in a first position and for fastening said overlapping ends together;

a driving mechanism for moving the upper tool section towards the lower section along a path, said driving mechanism comprising:

setting means comprising cam means for moving the upper tool section towards the lower tool section from the first position to a set position wherein the upper tool section is a distance above the lower tool section substantially equal to a sum of the thickness of the overlapping ends;

punching drive means for moving the upper tool section towards the lower tool section to produce at least one pair of angled hooking cuts in and along said overlapping ends, said punching drive means comprising eccentric shaft means having a throw, wherein rotation of the eccentric shaft means in a rotational direction causes the throw to act upon the upper tool section to produce the angled hooking cuts; and wherein said setting means moves said upper tool section to the set position before the punching drive means produces the angled hooking cuts; and wherein a force transferring member is located between the eccentric shaft means and the cam means, said force transferring member having a first curved contact surface facing the eccentric shaft means, said first curved contact surface corresponding to the cylindrical surface of the eccentric shaft means, and said force transferring member having a second curved contact surface facing a portion of the cam means, said second curved contact surface corresponding to a curvature of the portion of the cam means.

17. A strapping device as defined in claim 16 further comprising cutting means for cutting any excess metal from the overlapping ends of the strap after the angled hooking cuts are produced.

* * * * *